US010544020B2

(12) United States Patent
Delzenne et al.

(10) Patent No.: US 10,544,020 B2
(45) Date of Patent: Jan. 28, 2020

(54) HANDLING VEHICLE

(71) Applicant: MANITOU BF, Ancenis (FR)

(72) Inventors: Stéphane Delzenne, Ancenis (FR); Sylvain Poupard, Ancenis (FR)

(73) Assignee: MANITOU BF, Ancenis (FR)

( * ) Notice: Subject to any disclaimer, the term of this patent is extended or adjusted under 35 U.S.C. 154(b) by 57 days.

(21) Appl. No.: 15/776,496

(22) PCT Filed: Nov. 22, 2016

(86) PCT No.: PCT/FR2016/053044
§ 371 (c)(1),
(2) Date: Oct. 15, 2018

(87) PCT Pub. No.: WO2017/089693
PCT Pub. Date: Jun. 1, 2017

(65) Prior Publication Data

US 2019/0031479 A1 Jan. 31, 2019

(30) Foreign Application Priority Data

Nov. 24, 2015 (FR) ..... 15 61287

(51) Int. Cl.
*B66F 9/22* (2006.01)
*B66F 9/065* (2006.01)
*B66F 17/00* (2006.01)

(52) U.S. Cl.
CPC ..... *B66F 9/0655* (2013.01); *B66F 9/22* (2013.01); *B66F 17/003* (2013.01)

(58) Field of Classification Search
CPC ..... B66F 9/07572; B66F 17/003; B66F 9/22; B66F 9/0655
See application file for complete search history.

(56) References Cited

U.S. PATENT DOCUMENTS 3,156,170 A * 11/1964 Behrens ..... E01C 19/185 404/101
3,826,325 A * 7/1974 Purcell ..... B62D 55/08 180/9.54

(Continued)

FOREIGN PATENT DOCUMENTS

| | | |
|---|---|---|
| EP | 0945396 | 9/1999 |
| FR | 2849009 | 6/2004 |
| GB | 2336141 | 10/1999 |

OTHER PUBLICATIONS

International Search Report dated February 28, 2017.

*Primary Examiner* — John D Walters
*Assistant Examiner* — James J Triggs
(74) *Attorney, Agent, or Firm* — Ipsilon USA, LLP

(57) ABSTRACT

The invention relates to a load-handling vehicle provided with a driver's cab (1) and including a device for transporting a tool (2), which device comprises a telescopic boom (3) mounted to pivot in a plane parallel to the longitudinal plane of the vehicle (B-B) by means of a lifting jack (4) under the control of a power plant (5) arranged in a side casing (6), which plane is vertical when the vehicle is resting on horizontal ground (7) via wheels (8, 9, 10, 11), of which at least two front wheels or two rear wheels are driven by said power plant, the power plant comprising an engine (5A), a hydrostatic pump (5B), and a hydraulic pump (5C).
According to the invention, said pumps (5B, 5C) and at least 40% of the footprint area of said engine (5A) as projected onto a plane that is horizontal when the vehicle is resting on horizontal ground are located under said boom (3).

13 Claims, 3 Drawing Sheets

(56) References Cited

U.S. PATENT DOCUMENTS

| | | | | | |
|---|---|---|---|---|---|
| 5,607,330 | A * | 3/1997 | Hanz | B63B 7/02 | 114/344 |
| 5,687,809 | A | 11/1997 | Braud | | |
| 5,727,921 | A | 3/1998 | Brown | | |
| 5,971,493 | A * | 10/1999 | Robert | B60P 1/045 | 280/6.154 |
| 6,125,956 | A * | 10/2000 | Gignac | 180/9.1 | |
| 9,308,951 | B2 * | 4/2016 | Pare | B62D 55/14 | |
| 2003/0033772 | A1 * | 2/2003 | Russell | E04B 1/3404 | 52/292 |
| 2006/0251486 | A1 * | 11/2006 | Schamesberger | A63C 5/0428 | 409/159 |

* cited by examiner

HANDLING VEHICLE

RELATED APPLICATION

This application is a National Phase of PCT/FR2016/053044, filed on Nov. 22, 2016, which in turn claims the benefit of priority from French Patent application No. 15 61287, filed on Nov. 24, 2015 the entirety of which are incorporated by reference.

BACKGROUND

Field of the Invention

The invention relates to a load-handling vehicle provided with a driver's cab and including a device for transporting a tool, e.g. an excavator bucket, a fork, or a platform.

In particular, the invention relates to a vehicle that is suitable for handling industrial loads, e.g. in warehouses or on a construction site, in situations in which the vehicle may have limited maneuvering space.

Description of Related Art

Such a load-handling vehicle is described in patent document FR 2 765 865.

That load-handling vehicle provided with a driver's cab includes a load-transporting device comprising a telescopic boom mounted to be driven by means of a lifting jack to pivot in a plane that is parallel to the longitudinal plane of the vehicle, and that is vertical when the vehicle is resting on horizontal ground. A power plant controls transmission of the drive wheels and also the lifting, tilting, and compensation jacks, as well as jacks for deploying and retracting the telescopic boom.

In general, that power plant is arranged in a space placed under the seat of the driver's cab.

However, these days, engines are becoming more and more voluminous for environmental and power reasons and it can thus be problematic to place them under the seat, while conserving enough space in the driver's cab for comfort.

Another known load-handling vehicle is sold by WEIDEMANN under reference T4108.

That load-handling vehicle provided with a driver's cab includes a tool-transporting device comprising a telescopic boom mounted to pivot in a plane that is vertical when the vehicle is resting on horizontal ground.

It has a side casing containing the power plant.

The boom is arranged between the cab and that casing and the width of such a vehicle is therefore equal to the sum of the width of the cab, plus the width of the boom, plus the width of the power plant.

Patent document FR 2 849 009 describes a load-handling vehicle provided with a driver's cab and including a device for transporting a tool comprising a telescopic boom mounted to pivot in a plane parallel to the longitudinal plane of the vehicle by means of a lifting jack under the control of a power plant arranged in a side casing, which plane is vertical when the vehicle is resting on horizontal ground via wheels, of which at least two front wheels or two rear wheels are driven by the engine. The power plant is arranged in part under the boom.

OBJECTS AND SUMMARY

The object of the invention is to reduce the overall width of such a load-handling vehicle, by proposing a vehicle that is small and compact, while providing considerable driving comfort.

To do this, the invention provides a load-handling vehicle provided with a driver's cab and including a device for transporting a tool, which device comprises a telescopic boom mounted to pivot in a plane parallel to the longitudinal plane of the vehicle by means of a lifting jack under the control of a power plant arranged in a side casing, which plane is vertical when the vehicle is resting on horizontal ground via wheels, of which at least two front wheels or two rear wheels are driven by said power plant, the power plant comprising an engine, a hydrostatic pump, and a hydraulic pump, the vehicle being characterized in that said pumps and at least 40% of the footprint area of said engine as projected onto a plane that is horizontal when the vehicle is resting on horizontal ground are located under said boom.

The expression "located under the boom" means "located directly underneath the boom", on the same side of the longitudinal plane of the vehicle as the boom.

Thus, it is possible to obtain a total width for the load-handling vehicle that is less than 1.5 meters (m).

Preferably, said engine, said hydrostatic pump, and said hydraulic pump are mounted in line in a mounting plane which is horizontal when the vehicle is resting on horizontal ground, the line being inclined relative to the longitudinal plane of the vehicle.

Advantageously, said line is inclined at an angle lying in the range 10 degrees (°) to 25°, and preferably substantially equal to 19°.

Said engine may also be inclined relative to a plane that is vertical, when the vehicle is resting on horizontal ground, and advantageously the angle of this inclination is substantially equal to 10°.

Said side casing is preferably arranged between the front wheels and the rear wheels.

Preferably, said pumps are arranged between said driver's cab and said lifting jack of the boom.

By means of the above-described characteristics, taken alone or in combination, the width and the height of the side casing containing the power plant is reduced. By way of example, the cab may have a width of the order of 0.87 m and the side casing a width of the order of 0.62 m.

A reduction in the height of the side casing is also obtained, so as not to obstruct the driver's field of view in the cab with the boom arranged above the side casing, said boom presenting a maximum height of the order of 1.36 m relative to the ground, for example.

Said side casing may also contain a cooling system arranged in a support that is pivotable about an axis that is substantially vertical when the vehicle is resting on horizontal ground.

Thus, the cooling device can be moved easily, in order to provide access to the power plant.

Preferably, said boom is mounted on a pivot rod having a first axis of rotation that is stationary and a second axis of rotation that is connected to said lifting jack, said lifting jack presenting an angle of oscillation that is substantially equal to 5°.

Also advantageously, said lifting jack has a stationary rotary base at a distance from the axle of the two rear wheels that is less than 40% of the distance between the axles of the front and rear wheels.

Preferably, said tool is fastened on a spacer arranged laterally at the front end of said boom, on the same side as the cab.

By way of example, the offset between the longitudinal plane of the spacer and the longitudinal plane of the boom is of the order of 0.29 m.

This thus ensures that the driver can comfortably see the tool, despite the lateral position of the boom.

Advantageously, all four front and rear wheels are driven by the power plant.

BRIEF DESCRIPTION OF THE DRAWINGS

The invention is described below in more detail by means of the figures, which show only one preferred embodiment of the invention.

DETAILED DESCRIPTION

Figure 1:
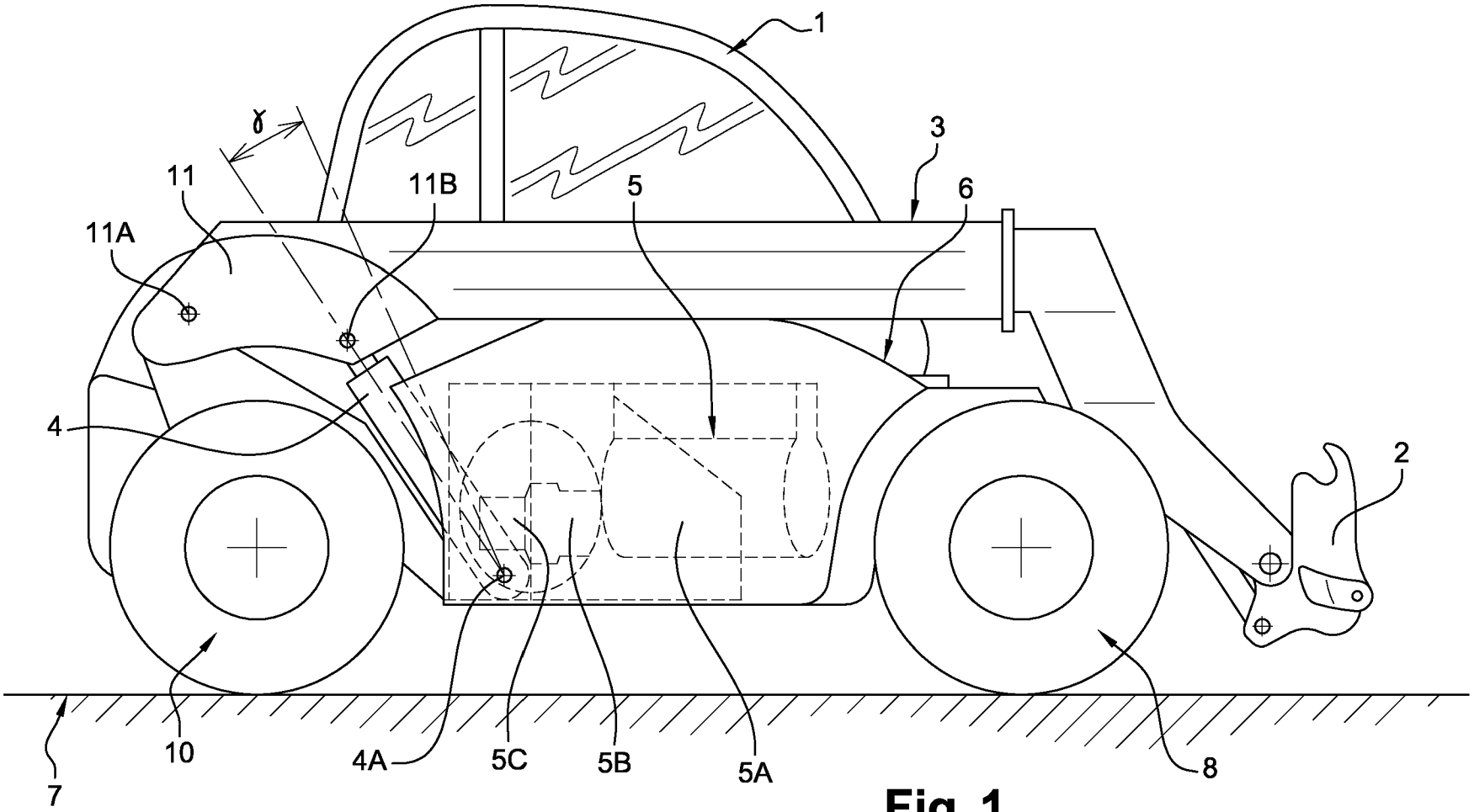
FIG. 1 is a side view of a load-handling vehicle of the invention.
Figure 2:
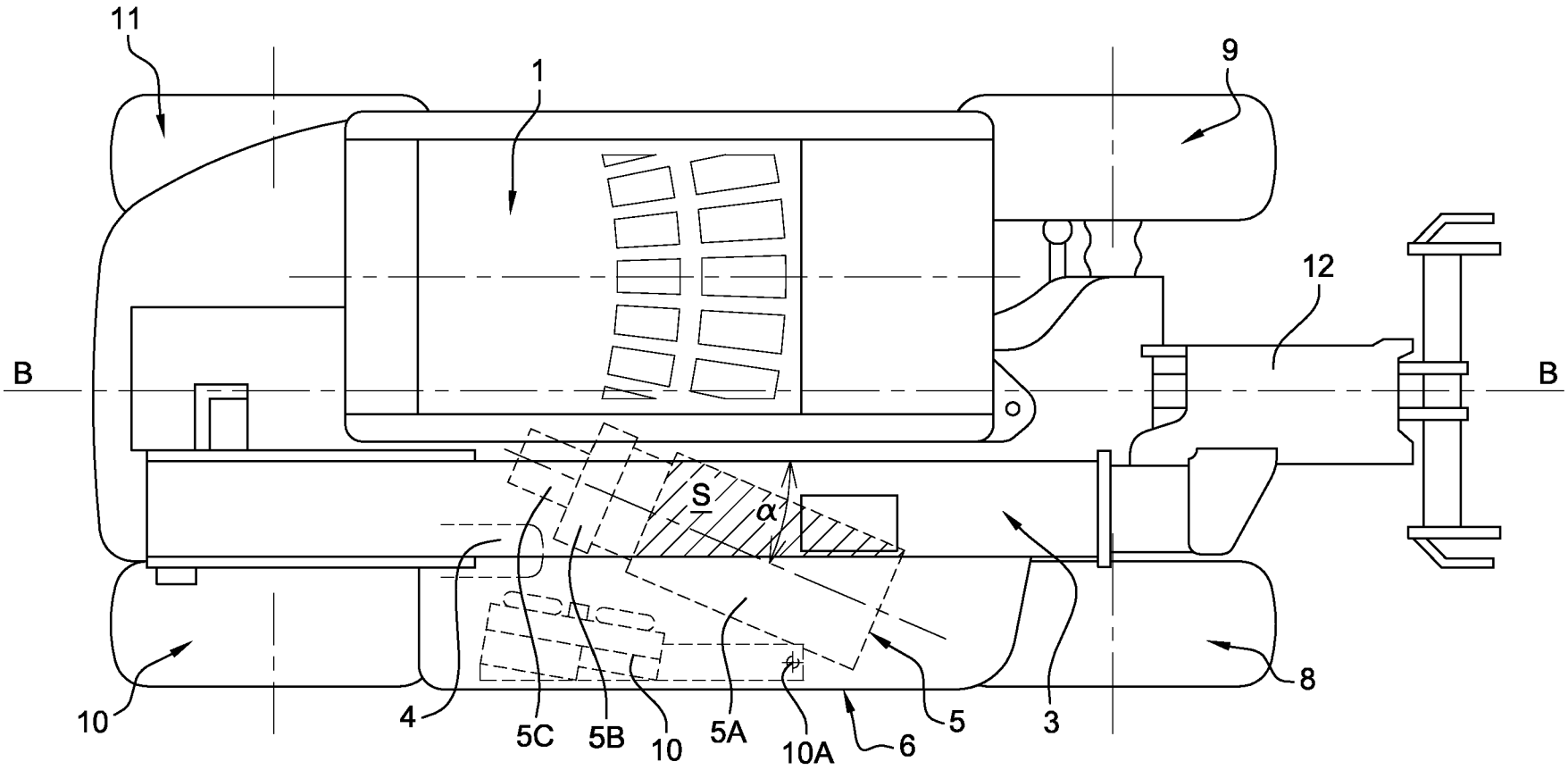
FIG. 2 is a plan view of said same load-handling vehicle.

As shown in FIGS. 1 and 2, a load-handling vehicle provided with a driver's cab 1 comprises a device for transporting a tool 2, in this embodiment an excavator bucket, comprising a telescopic boom 3 mounted to pivot in a plane parallel to the longitudinal plane B-B of the vehicle by means of a lifting jack 4 under the control of a power plant 5 arranged in a side casing 6 arranged between the front and rear wheels 8 to 11, which planes are vertical when the vehicle is resting on horizontal ground 7 via its wheels, of which at least two front wheels 8, 9 or two rear wheels 10, 11 are driven by the power plant 5. This longitudinal plane B-B of the vehicle is the vertical plane of symmetry between wheels.

Advantageously, all four front and rear wheels are drive wheels and driven by the power plant.

In the invention, the power plant 5 is arranged at least in part below the boom 3.

The power plant 5 comprises an engine 5A, a hydrostatic pump 5B designed to control the transmission of the vehicle and a hydraulic pump 5C designed to control the lifting jack 4, the tilting jack, and compensation jack, as well as jacks for deploying and retracting the telescopic boom, which are not all shown in the figures for reasons of simplification.

More precisely, the hydrostatic and hydraulic pumps 5B, 5C and at least 40% of the footprint area of the engine S as projected onto a plane that is horizontal when the vehicle is resting on horizontal ground are located under the boom 3.

The engine 5A, the hydrostatic pump 5B, and the hydraulic pump 5C are mounted in line in a mounting plane which is horizontal when the vehicle is resting on horizontal ground, the line being inclined relative to the longitudinal plane B-B of the vehicle. More precisely, the line is inclined at an angle $\alpha$ lying in the range 10° to 25° and is preferably substantially equal to 19°.

Figure 3:
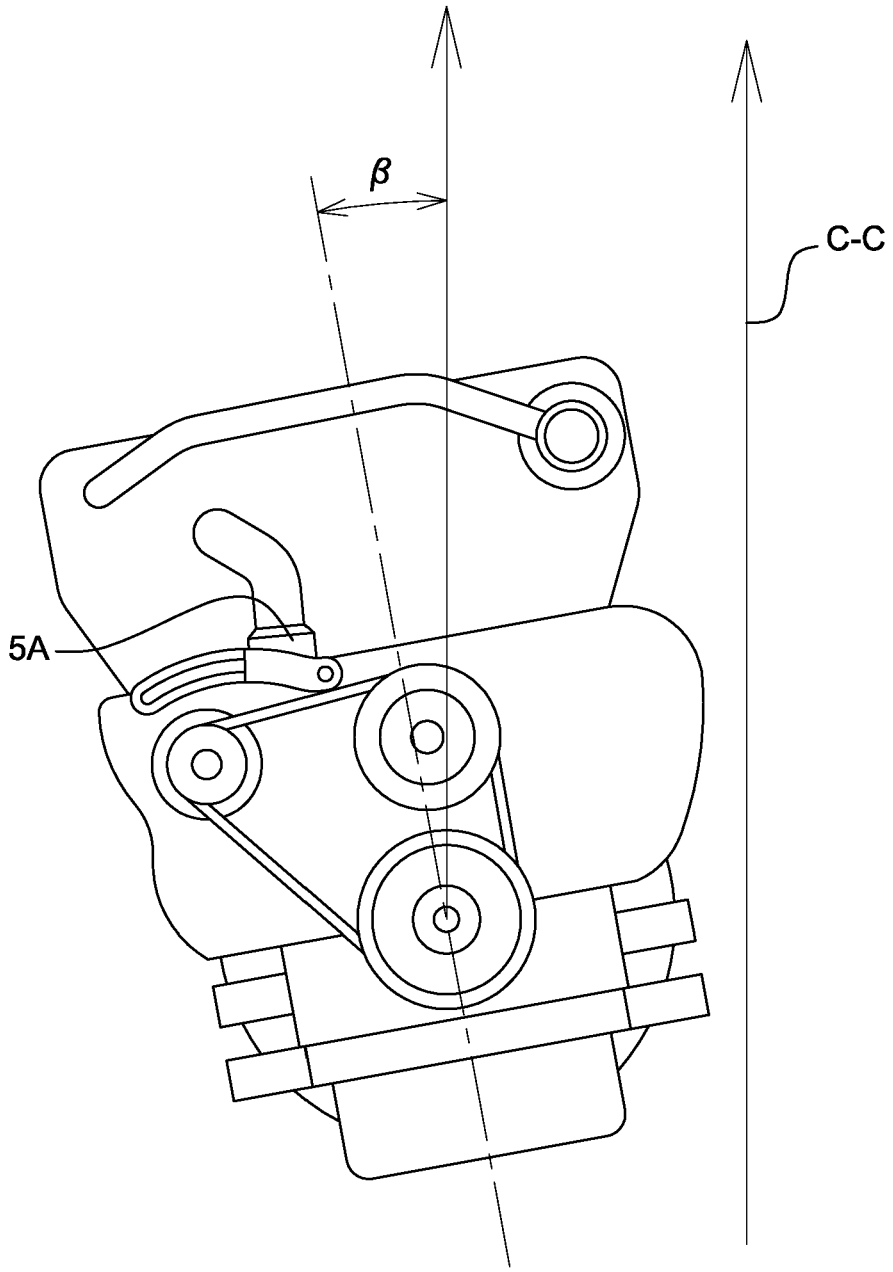
FIG. 3 is a section view on line A-A of FIG. 2.

The engine may also be inclined relative to a plane C-C that is vertical when the vehicle is resting on horizontal ground, at an angle $\beta$ of the order of 10°, as shown in FIG. 3.

The pumps 5B, 5C are arranged between the driver's cab 1 and the lifting jack 4 of the boom.

The side casing 6 also contains a cooling system 10 arranged on a support that is pivotable about an axis 10A that is substantially vertical, when the vehicle is resting on horizontal ground. This cooling device is constituted by heat exchangers and by a cooling fan.

The boom 3 is mounted on a pivot rod 11 having a first axis of rotation 11A that is stationary and a second axis of rotation 11B that is connected to the lifting jack 4, this lifting jack 4 presenting an angle of oscillation $\gamma$ that is less than 15° and preferably substantially equal to 5°.

And the lifting jack 4 has a stationary rotary base 4A at a distance from the axle of the two rear wheels 10, 11 that is less than 40% of the distance between the axles of the front and rear wheels.

The tool 2 is fastened on a spacer 12 arranged laterally at the front end of the boom 3, on the same side as the cab 1.

The invention claimed is:

1. A load-handling vehicle comprising:

provided with a driver's cab and including a device for transporting a tool, which device has a telescopic boom mounted to pivot in a plane parallel to a longitudinal plane of the vehicle by means of a lifting jack under the control of a power plant arranged in a side casing, which plane is vertical when the vehicle is resting on horizontal ground via wheels, of which at least two front wheels or two rear wheels are driven by said power plant, the power plant comprising an engine, a hydrostatic pump, and a hydraulic pump, wherein said pumps and at least 40% of the footprint area of said engine as projected onto a plane that is horizontal when the vehicle is resting on horizontal ground are located under said boom.

2. A vehicle according to claim 1, wherein said engine, said hydrostatic pump, and said hydraulic pump are mounted in line in a mounting plane which is horizontal when the vehicle is resting on horizontal ground, the line being inclined relative to the longitudinal plane of the vehicle.

3. A vehicle according to claim 2, wherein the angle of this inclination $\alpha$ lies in the range 10° to 25°.

4. A vehicle according to claim 3, wherein the angle of this inclination $\alpha$ is substantially equal to 19°.

5. A vehicle according to claim 3, wherein said engine is also inclined relative to a plane that is vertical when the vehicle is resting on horizontal ground.

6. A vehicle according to claim 5, wherein the angle of this inclination $\beta$ is substantially equal to 10°.

7. A vehicle according to claim 1, wherein said side casing is arranged between the front wheels and the rear wheels.

8. A vehicle according to claim 1, wherein said pumps are arranged between said driver's cab and said lifting jack of the boom.

9. A vehicle according to claim 1, wherein said side casing also contains a cooling system arranged on a support that is pivotable about an axis that is substantially vertical when the vehicle is resting on horizontal ground.

10. A vehicle according to claim 1, wherein said boom is mounted on a pivot rod having a first axis of rotation that is stationary and a second axis of rotation that is connected to said lifting jack, said lifting jack presenting an angle of oscillation $\gamma$ that is substantially equal to 5°.

11. A vehicle according to claim 10, wherein said lifting jack has a stationary rotary base at a distance from the axle of the two rear wheels that is less than 40% of the distance between the axles of the front and rear wheels.

12. A vehicle according to claim 1, wherein said tool is fastened on a spacer arranged laterally at the front end of said boom, on the same side as the cab.

13. A vehicle according to claim 1, wherein all four front and rear wheels are driven by the power plant.

* * * * *